United States Patent [19]

McPhee

[11] 4,387,773

[45] Jun. 14, 1983

[54] SHAPED CHARGE WELL PERFORATOR

[75] Inventor: William A. McPhee, Jersey Village, Tex.

[73] Assignee: Dresser Industries, Inc., Dallas, Tex.

[21] Appl. No.: 311,105

[22] Filed: Oct. 13, 1981

[51] Int. Cl.[3] ..... E21B 43/117

[52] U.S. Cl. ..... 175/4.6; 102/476; 102/306

[58] Field of Search ..... 175/4.6; 166/299; 102/306, 307, 476; 175/4.58, 4.59

[56] References Cited

U.S. PATENT DOCUMENTS

| | | | |
|---|---|---|---|
| 2,782,715 | 2/1957 | Udry | 102/20 |
| 2,892,407 | 6/1959 | MacLeod | 102/24 |
| 2,984,307 | 5/1961 | Barnes | 175/2 |
| 2,988,994 | 6/1961 | Fleischer, Jr. et al. | 102/24 |
| 3,129,665 | 4/1964 | Evans, Jr. | 102/56 |
| 3,154,014 | 11/1964 | Dunne | 102/23 |
| 3,358,780 | 12/1967 | Venghiattis | 175/4.5 |
| 4,220,687 | 9/1980 | Christopher | 175/4.6 |

*Primary Examiner*—Stephen J. Novosad
*Assistant Examiner*—Thuy M. Bui
*Attorney, Agent, or Firm*—Richard M. Byron; Patrick H. McCollum

[57] ABSTRACT

A shaped charge unit for well perforating having a outer shell with an internal cavity formed therein. An explosive charge material conforms in exterior shape with the inside surface of the cavity and is retained in place by a conical liner of non-explosive material. The interior shape of the cavity is such that an increased amount of explosive material is provided in a circumferential channel located proximate to the periphery of the base of the conical liner.

14 Claims, 3 Drawing Figures

SHAPED CHARGE WELL PERFORATOR

BACKGROUND OF THE INVENTION

This invention relates in general to well perforators and more specifically, to improvements in lined shaped charge means for perforating well casings and the surrounding earth formations.

Explosive shaped charge well perforating devices are often used in the perforating of oil well casing and the surrounding earth formations. In the typical embodiment, a plurality of shaped charges are mounted in a fluid-tight, cylindrical, metal housing or on an elongated bar member which is adapted to traverse the borehole to be perforated. The shaped charges are mounted in the housing or on the bar member at longitudinally spaced intervals, with their axis of perforation directed laterally thereof.

The shaped charge most common in well perforating is a conical shaped charge. A conical shaped charge consists of an explosive material having a substantially conical cavity formed in the front face. A metal liner material covers the face of the cavity. Upon detonation the shape of the explosive cavity focuses and propagates a progressive wave front against the outside surface of the metal liner. At the pressures generated, the metal acts as a fluid. Metal in atomized form is squirted into a focused jet stream. The resultant focusing force moves particles forward and relatively backward to form a jet which lengthens as the wave front advances from apex to base of the conical cavity. The extreme high pressure, particle-laden jet stream breaks down and moves aside any material upon which it impinges. Penetration of such material is a result of the amount of pressure and the kinetic energy in the jet stream. The greater the length of the jet stream, the greater the depth of penetration.

It is highly desirable that a perforation in the formation be as deep as possible so that fluid in the formation may have access to the borehole. One way to increase the length of the jet stream is to deepen the conical cavity, that is, to decrease the apex angle of the cavity. However, if the angle is decreased below 25°, the Monroe effect disappears and the charge explodes like a petard. Another method of increasing the length of the jet stream is to build a charge of a larger caliber. However, increasing the caliber presents many drawbacks. As the caliber of the charge increases, the size and weight of the perforating instrument housing the charge has to be correspondingly increased. The restrictive diameter of an oil well limits the size of the perforating instrument operated therein and thus limits the caliber of the charge.

These and other disadvantages are overcome with the present invention by providing a method and apparatus for perforating a well casing and the surrounding formations using a lined shaped charge having a jet stream of increased length whereby the depth of penetration is substantially increased without increasing the caliber of the lined shaped charge.

SUMMARY OF THE INVENTION

A shaped charge perforating unit comprising a housing or shell with an internal cavity formed therein. A explosive charge of high explosive material conforms in exterior shape with the inside surface of the cavity and is retained in place by a conical liner of non-explosive material. The explosive charge is comprised of a booster section located below the apex of the cone, a main explosive charge section substantially surrounding the outer periphery of the liner and a circumferential band or channel of explosive material located proximate the base or area of maximum periphery of the conical liner. A detonator fuse is located proximate the booster charge section. Upon detonation of the booster charge by the detonator fuse a detonation wavefront travels forwardly, simultaneously collapsing the liner to form an atomized jet stream. The band of explosive material provides an increased mass of explosive material about the maximum periphery of the conical liner providing the increased energy required to put this area of maximum cone mass into the jet stream thereby increasing the length of the jet stream and thus the depth of penetration of the formation.

Accordingly, it is a feature of the present invention to provide a new and improved lined shaped charge with increased depth of penetration.

It is another feature of the present invention to provide a lined shaped charge perforating unit having an increased depth of penetration without a corresponding increase in physical size or caliber.

It is yet another feature of the present invention to provide a lined shaped charge perforating unit wherein an increased amount of the conical liner is atomized into a jet stream.

These and other features and advantages of the present invention will be more readily understood by those skilled in the art from a reading of the following detailed description with reference to the accompanying drawing.

DETAILED DESCRITPION OF THE PEREFERRED EMBODIMENT

Figure 1:
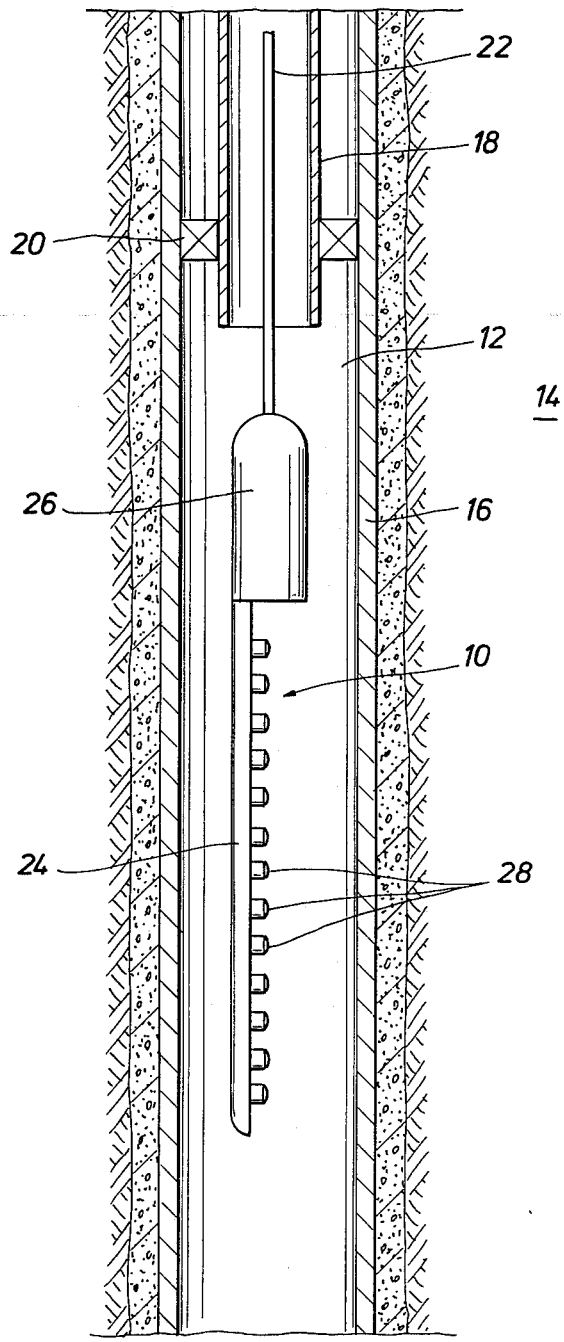
FIG. 1 is a pictorial view, partly in cross-section, of a perforating instrument disposed in a typical borehole.

Referring to the drawings in detail, especially to FIG. 1, there is illustrated a perforating apparatus 10 incorporating the principles of the present invention. As illustrated, perforating apparatus 10 is positioned within a wellbore 12 penetrating earth formations 14. A string of casing 16 is cemented in the wellbore 12 with a smaller diameter production pipe 18 carrying a production packer 20 arranged for communicating the isolated wellbore interval below. Perforating apparatus 10 is suspended in the wellbore by cable or wireline 22 which is wound on or unwound from a drum (not shown) located at the earth's surface for positioning adjacent the formations to be perforated.

Perforating apparatus 10 includes an elongated body member 24 which can be a carrier strip or a pressure and fluid sealed housing and is suspended below a collar locating instrument 26. Perforating apparatus 10 further includes a plurality of encapsulated shaped charges 28 mounted on or within body member 24. Shaped charges 28 are each mounted at relatively closely-spaced intervals along body member 24 and are mounted with their axis of perforation facing the earth formations 14.

Figure 2:
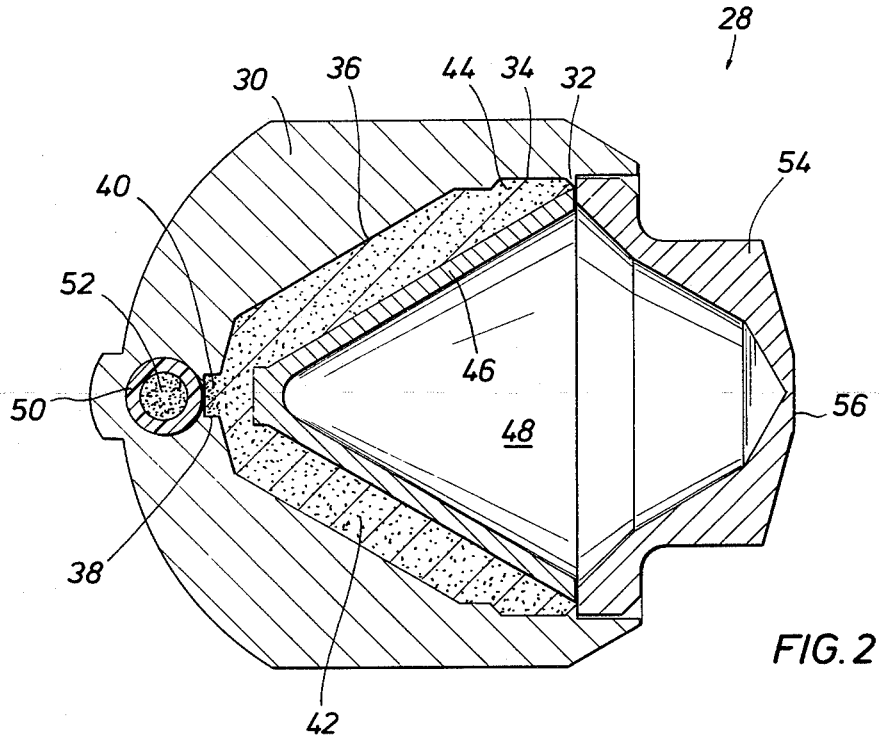
FIG. 2 is a longitudinal cross-section of a shaped charge unit in accordance with the present invention.

Referring now to FIG. 2 there is illustrated a lined shaped charge unit 28 adapted for perforating oil well casing and the surrounding earth formations. The shaped charge unit 28 is formed within a cavity formed in a housing or shell 30. The housing or shell 30 may be made of any suitable material, such as, for example steel or aluminum. Housing or shell 30 may have any one of numerous outside configurations as is common in the art, for example, the generally uniform outside diameter as illustrated in the drawing or a frusto-conical appearance.

The cavity formed in the interior of housing or shell 30 has a generally cylindrical forward end portion 32 with a recess or channel 34, illustrated in FIG. 2 as generally trapezoidal in shape, formed therein, a tapered, intermediate portion 36 and an apex with a reduced rear end extension 38. The explosive charge comprises a tubular or annular shaped body of high explosive material, conforming in exterior shape with the shape of the inner surface of the cavity formed within housing or shell 30. The explosive charge comprises three sections, the booster charge section 40, the main charge section 42 and the explosive booster band 44. A liner 46 retains the explosive charge within housing or shell 30. Liner 46 is generally conical in shape and is constructed of a suitable non-explosive material preferably having a relatively high density, such as, for example, copper and has an interior, conical, forwardly diverging passage 48 conforming in shape with the interior surface of liner 46. The explosive charge preferably should be a high explosive material such as that commonly known as Cyclonite.

The rear of shell 30, is formed with a traverse opening or passage 50 adjacent the rearward end of booster charge section 40 of the explosive charge into which may be inserted a detonator fuse 52. The detonator fuse 52 is preferably of an explosive or detonating type such as, for example, the type known commercially as P.E.T.N. plastic covered Primacord. A port plug or sealing member 54 is affixed to shell 30 to provide a fluid tight seal. Port plug 54 is formed with a relatively thin end wall or diaphragm 56 positioned substantially in alignment with the longitudinal, perforating axis of the shaped charge unit. Port plug 54 may be crimp attached to shell 30 or threadably attached thereto and can be constructed of any suitable material such as brass, aluminum or copper.

In the operation of the invention, detonator fuse 52 is detonated by an ignitor or blasting cap (not shown). Detonator fuse 52 will detonate booster charge section 40 of the explosive charge thereby detonating the main explosive charge section 42. A detonation wave thus caused travels forwardly and strikes the apex of the liner cone 46. The wavefront continues traveling forwardly through the main explosive charge section 42 simultaneously collapsing liner 46 symmetrically inwardly about the axis of the liner 46 causing the inner surface of liner 46 to atomize to form part of a jet stream.

One difficulty with prior art shaped charges is there is insufficient energy available in the base or maximum periphery area of the liner to effectively atomize the base area in order for it to become part of the jet stream. The present invention overcomes this deficiency by placing a booster band 44 of explosive material about the pheriphery of the base area of liner 46. The addition of booster band 44 proximate the base area of liner 46 increases the amount of energy available to put this area of the liner material into the jet stream thereby increasing the length of the jet stream and thus the depth of penetration of the formations. The increased depth of penetration is achieved without increasing the caliber of the shaped charge. In the preferred embodiment, from between ten percent to fifteen percent of the total explosive material can be located within the channel area with a corresponding reduction of explosive material in the main explosive charge section.

Figure 3:
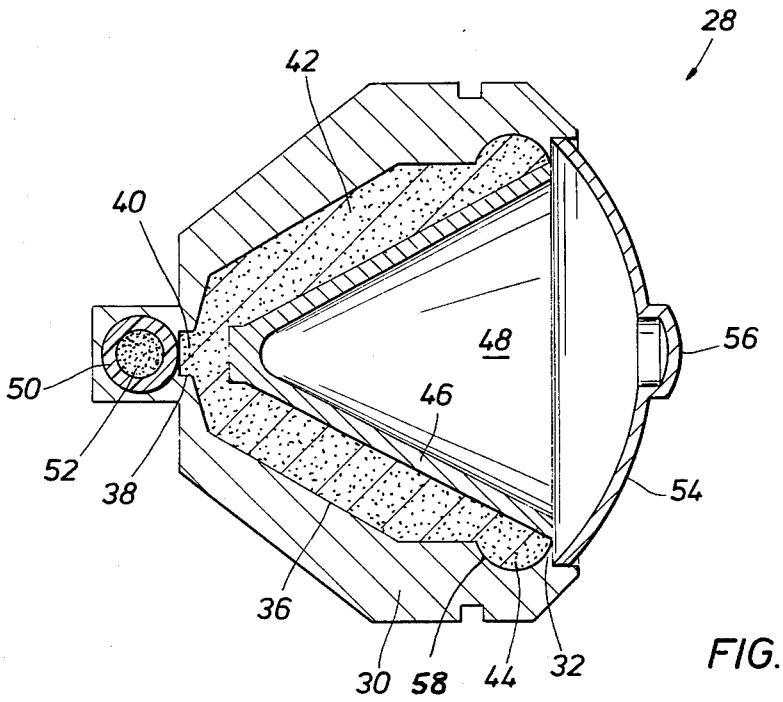
FIG. 3 is a longitudinal cross-section of an alternate embodiment of a shaped charge unit in accordance with the present invention.

Referring now to FIG. 3, there is illustrated a second embodiment of the present invention, for ease of understanding like elements of FIG. 2 and FIG. 3 are numbered identically. In FIG. 3, shaped charge unit 28 has a housing or shell 30 which is generally frusto-conical in appearance. Located in the generally cylindrical forward end portion 32 is recess or channel 58, illustrated as being generally hemispheroidal in shape, retaining explosive booster band 44.

In operation, the shaped charge unit of FIG. 3 functions identical to the shape charge unit operation previously described. Detonation of detonator fuse 52 detonates booster charge section 20 of the explosive charge further detonating the main explosive charge section 42, as the detonation wave travels through the main explosive charge section 42, liner 46 collapses inwardly causing a jet stream to be formed. The detonation wave continues detonating explosive booster band 44 thereby placing an increased amount of the base area of liner 46 into the jet stream.

To illustrated the increased penetrating efficiency of the present invention experiments were conducted whereby an equal number of the charges and without a booster band of explosive the new and improved charges of the present invention were compared under like conditions. The explosive charges tested were $2\frac{1}{8}$ inch diameter bar gun charges with an explosive weight of 15.5 grams and having a copper cone liner. These charges were shot in air into a target of Berea sandstone using a stand-off of 0.70 inches and 80 grain primacord. The shaped charges without a booster band of explosives averaged a depth of penetration of 8.35 inches with an average entrance hole of 0.367 inches. The new and improved shaped charges of the present invention averaged a depth of penetration of 9.92 inches with an average entrance hole diameter of 0.397 inches. The described results indicate an approximate improvement of nineteen percent in depth of penetration and twenty percent in entrance hole diameter.

While the description and drawings illustrate a shaped charge unit utilizing an explosive booster band having generally trapezoidal and hemispheroidal configurations, it should be recognized that numerous other designs will provide the attendant benefits. For example, a semi-eliplical or triangular channel for retaining the explosive booster band can be formed in the housing proximate the base of the conical liner to provide the increased energy required to increase the jet stream length and thus increase the depth of penetration. Accordingly, it should be clearly understood that the form of the invention described and illustrated herein are exemplary only, and are not intended as limitations on the scope of the present invention.

The embodiments of the invention in which an exclusive property or privilege is claimed are defined as follows:

1. An explosive shaped charge comprising:

a housing having a forwardly opening cavity formed therein, said cavity including a generally cylindrcial frontal portion having a channel formed therein, a tapered intermediate portion and a rearwardly located apex;

a charge of high explosive material within said cavity, the outer surface of said explosive material conforming to the inner surface of said cavity; and a forwardly diverging conical liner having an apex in alignment with the apex of said cavity, said liner cooperatively arranged to retain said explosive material in said cavity.

2. The shaped charge of claim 1 further including detonating means located behind the apex of said cavity for selectively detonating said explosive material.

3. The shaped charge apparatus of claim 2 wherein from between ten percent and fifteen percent of said explosive material is located in the channel area within said frontal portion of said cavity.

4. The shaped charge apparatus of claim 3 wherein said channel is generally trapezoidal in shape.

5. The shaped charge apparatus of claim 3 wherein said channel is generally hemispheroidal in shape.

6. Perforating apparatus for use in a borehole comprising:

an elongated body member adapted for passage through a borehole;

at least one shaped charge unit cooperatively disposed along the longitudinal axis of said body member;

said shaped charge means including a hollow charge casing, a frusto-conical liner having an inner apex and an outer base, and high explosive charge material coaxially disposed between said charge casing and said liner cooperatively arrange to provide a circumferential mass of explosive material proximate of said base of said liner;

sealing means for fluidly isolating the interior of said shaped charge means from said borehole; and means for detonating said explosive charge material.

7. The perforating apparatus of claim 6 wherein said circumferential mass of explosive material comprises from between ten percent to fifteen percent of the total explosive material.

8. The perforating apparatus of claim 7 wherein said circumferential mass of explosive material is located within a band generally trapezoidal in shape.

9. The perforating apparatus of claim 7 wherein said circumferential mass of explosive material is located within a band generally hemispheroidal in shape.

10. An explosive shaped charge unit, comprising:

a housing having a forwardly opening cavity formed therein, said cavity including frontal opening portion having a peripherally disposed and radially outwardly directed and inwardly opening recess formed therein, a tapered intermediate portion and a rearwardly located apex;

a high explosive material within said cavity, the outer surface of said explosive material conforming to the inner surface of said cavity including said annular recess; and a forwardly diverging conical liner having an apex in axial alignment with the apex of said cavity.

11. The shaped charge unit of claim 10 wherein from between ten percent to fifteen percent of the total mass of said explosive material is located in the annular recess area of said frontal portion of said cavity.

12. The shaped charge unit of claim 11 wherein said annular recess is generally trapezoidal in configuration.

13. The shaped charge unit of claim 11 wherein said annular recess is generally hemispheroidal in configuration.

14. The shaped charge unit of claim 12 or 13 further including detonating means axially positioned to the rear of the apex of said cavity for selectively detonating said explosive material.

* * * * *